United States Patent [19]

Haas

[11] 4,034,251

[45] July 5, 1977

[54] TRANSMISSION X-RAY TUBE

[75] Inventor: David J. Haas, Stamford, Conn.

[73] Assignee: North American Philips Corporation, New York, N.Y.

[22] Filed: Feb. 23, 1976

[21] Appl. No.: 660,698

[52] U.S. Cl. ..... 313/59; 313/44

[51] Int. Cl.[2] ..... H01J 35/00

[58] Field of Search ..... 313/59, 11, 44

[56] References Cited

UNITED STATES PATENTS

| | | | |
|---|---|---|---|
| 1,967,869 | 7/1934 | Coolidge | 313/59 |
| 2,896,105 | 7/1959 | Hosemann | 313/59 X |
| 2,922,060 | 1/1960 | Rajewsky | 313/59 |

*Primary Examiner*—Rudolph V. Rolinec

*Assistant Examiner*—Darwin R. Hostetter

*Attorney, Agent, or Firm*—Frank R. Trifari

[57] ABSTRACT

The present invention comprises an x-ray transmission target tube that includes an envelope; x-ray permeable window means disposed at the envelope and forming a part thereof; means for directing a charged particle beam to the window means to generate x-rays thereat; structural means for providing a space at the window means, which structural means comprises an x-ray permeable window element that is disposed opposite the window means and further comprises wall means, which structural means, together with the window means, forms the space; and means for transferring a heat-transfer fluid through the space so as to be in heat transfer relationship with the window means.

6 Claims, 3 Drawing Figures

TRANSMISSION X-RAY TUBE

BACKGROUND OF THE INVENTION

The present invention relates to an improved x-ray tube, particularly to same of the x-ray transmission variety.

X-ray tubes are well-known in the art, a particular type thereof, namely, the x-ray transmission target tubes, being widely used. Because in the transmission tube, electrons strike a window that also serves as the tube anode, and produce the x-rays, the resulting x-rays must be able to penetrate the window of the tube to reach the outside world. Therefore, such a window generally must be relatively thin to minimize the x-ray absorption therein.

As a result of the requirement of a thin window in these tubes, they are, of necessity, power-limited since their operation at higher power levels results in rapid and excessive heating of the window, leading to damage thereto and eventual failure of the tube. Because transmission target tubes are necessarily operated at lower power levels, e.g., about 2 watts, most of the x-ray tubes that are employed are of the back-reflection type, which produce only relatively narrow x-ray beams, i.e., beams having a beam divergence angle $\theta$, of less than 40° and generally beams having a $\theta$ value of about 15° to 30°.

As compared to transmission target x-ray tubes, the achievement of an equivalent x-ray output from a reflection type tube requires greater power input than is so for transmission target tubes, this being so up to a certain power level, e.g., about 2 watts, to which the transmission target tubes are, as a practical matter, limited. Consequently, due to their power limiting factor, a substantially reduced x-ray output results from the use of transmission target tubes which do, however, provide a soft x-ray beam quality that is superior for many applications. A glass window tube may be used but this results in an undesirable degree of x-ray attenuation from the tube.

Where a wider angle beam (i.e., $\theta$ value of about 40°) is desired and/or where a soft x-ray beam is sought, it is generally necessary to utilize a back-reflection x-ray tube, with a large beryllium window, which is not always desirable from a mechanical and reliability standpoint.

One proposed solution to the thermal problem in transmission x-ray tubes operated at higher power levels, is the provision of a solid heat sink on the transmission window of the tube. However, this is of limited benefit and usefulness since the maximum power level at which such tubes can be operated is on the order of about 2 Watts.

The present invention provides an x-ray transmission target tube that has significant advantages over prior art devices and affords other benefits as well.

BRIEF SUMMARY OF THE INVENTION

The present invention comprises an x-ray transmission tube that includes an envelope; x-ray permeable window means disposed at the envelope and forming a part thereof; means for directing a charged particle beam to the window means to generate x-rays thereat; structural means for providing a space at the window means, which structural means comprises an x-ray permeable window element that is disposed opposite the window means and further comprises wall means, which structural means, together with the window means, forms the space; and means for transferring a heat-transfer fluid through the space so as to be in heat transfer relationship with the window means.

PREFERRED EMBODIMENT

Figure 1:
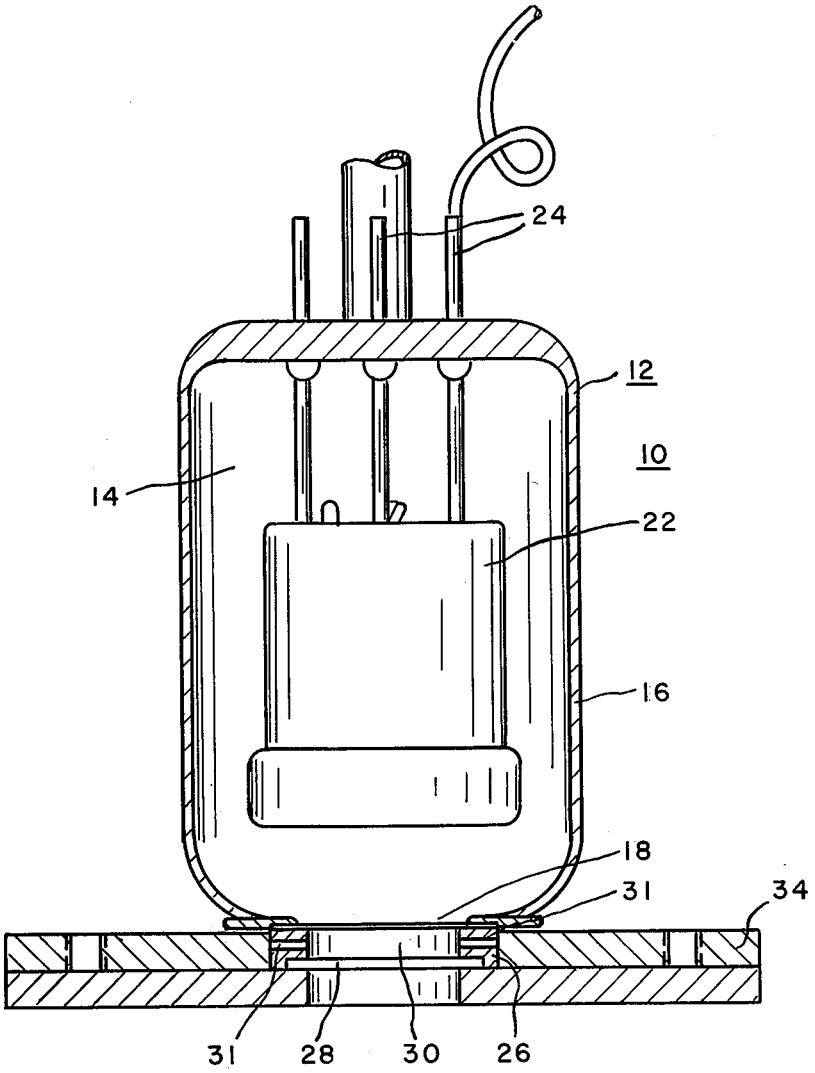
FIG. 1 is a sectional elevation view of the transmission x-ray tube according to a preferred embodiment of the invention.

Referring to FIG. 1, the transmission x-ray tube 10 comprises an envelope portion 12 containing an evacuated chamber 14 and including a wall element 16 and a window member 18 that forms part of the envelope. The wall element 16 can be of glass or other suitable material, while the window member 18 can be of gold on beryllium, or other material capable of generating x-rays in response to impingement of charged particles, e.g., electrons, thereon.

The window member 18 preferably is mounted at the end of the tube, although some other location might be possible. According to a preferred embodiment, the window member 18 extends completely across the opening in the wall element 16 and is mounted on the wall element 16 and is connected thereto by means of a glass-to-metal seal of the type known in the art or other means capable of providing an air-tight seal.

The tube 10 also contains a source of charged particles, which can be, for example, a cathode 22 that is disposed opposite and on axis with the window member 18 so that electrons are directed to the latter, it being possible to utilize electromagnetic or electrostatic means for controlling the electron beam. Also present are suitable electrical leads 24 for introducing into and removing from the cathode 22 and other component parts, if any, electrical energy.

The window member 18 preferably is relatively thin, e.g., about 10 mils thickness, so as to minimize its absorption of the x-rays that are produced by the impingement of electrons thereon.

The tube 10 further includes an annular mounting element 26, which is mounted (either removably or fixedly) on the wall element 16 at the window member 18 such that the window member 18 is wholly or partly located at the interior space of the mounting element 26. A second window 28 is disposed on and extends across the interior space of the annular mounting element 26, the second window being connected thereto. The mounting element 26, window member 18, and second window 28 together form a space 30, there being passageways 31/by which a heat-transfer fluid, such as e.g., a cooling oil, can be circulated through the space 30 so as to flow across the window member 18 and remove heat therefrom. It is preferred that the second window 28 be of a low atomic number material, e.g., Formica, Bakelite, beryllium, or a low density plastic, or some other material exhibiting a high transmissivity to the x-rays, which characteristic is desired, also, for the heat transfer fluid, which can be a liquid or a gas.

The tube 10 can also include a mounting flange 34 located at the mounting element 26, by means of which flange the tube 10 can be mounted on a support (not shown). The system (not shown) for circulating the heat transfer fluid can include suitable pumping means and a heat exchanger, where desired, the tube 10 being connected to the system when in use.

The present invention permits the transmission tube 10 to be operated at significantly higher power levels than heretofore possible; to wit, such a tube has been operated at 10 Watts, whereas previous tubes generally were limitd to operation at about 2 Watts. It is expected that the present invention will provide transmission x-ray tubes operable at levels much higher than 10 watts.

Another advantage afforded by the present invention is that, since back reflection x-rays tubes are not required to obtain a wide angle x-ray beam having soft x-rays, but, instead, these advantages are available with the present transmission x-ray tube, substantial space savings are achieved since the transmission tube is significantly shorter in length. Also, an x-ray beam having a small focal spot is obtainable with the invention.

It is generally preferred that the window member 18 be substantially planar at the face thereof bounding the space or channel through which the heat transfer fluid is passed, so as to minimize the possibility of a turbulent flow of the fluid and achieve more a laminar flow, thereby enhancing heat transfer from the window member 18.

The distance between the window member 18 and the second window (i.e., the height of the fluid transfer space of channel) can be relatively small, e.g., about 1 mm. However, where the anode of the tube, i.e., the window member 18, is hot, that is, where it is not electrically grounded, the height of the space or channel should be at least sufficent to permit electrical insulation between the window member 18 (i.e., the transmission window) and the outside world (i.e., the x-ray transparent window) to be provided by the heat transfer fluid.

Figure 2:
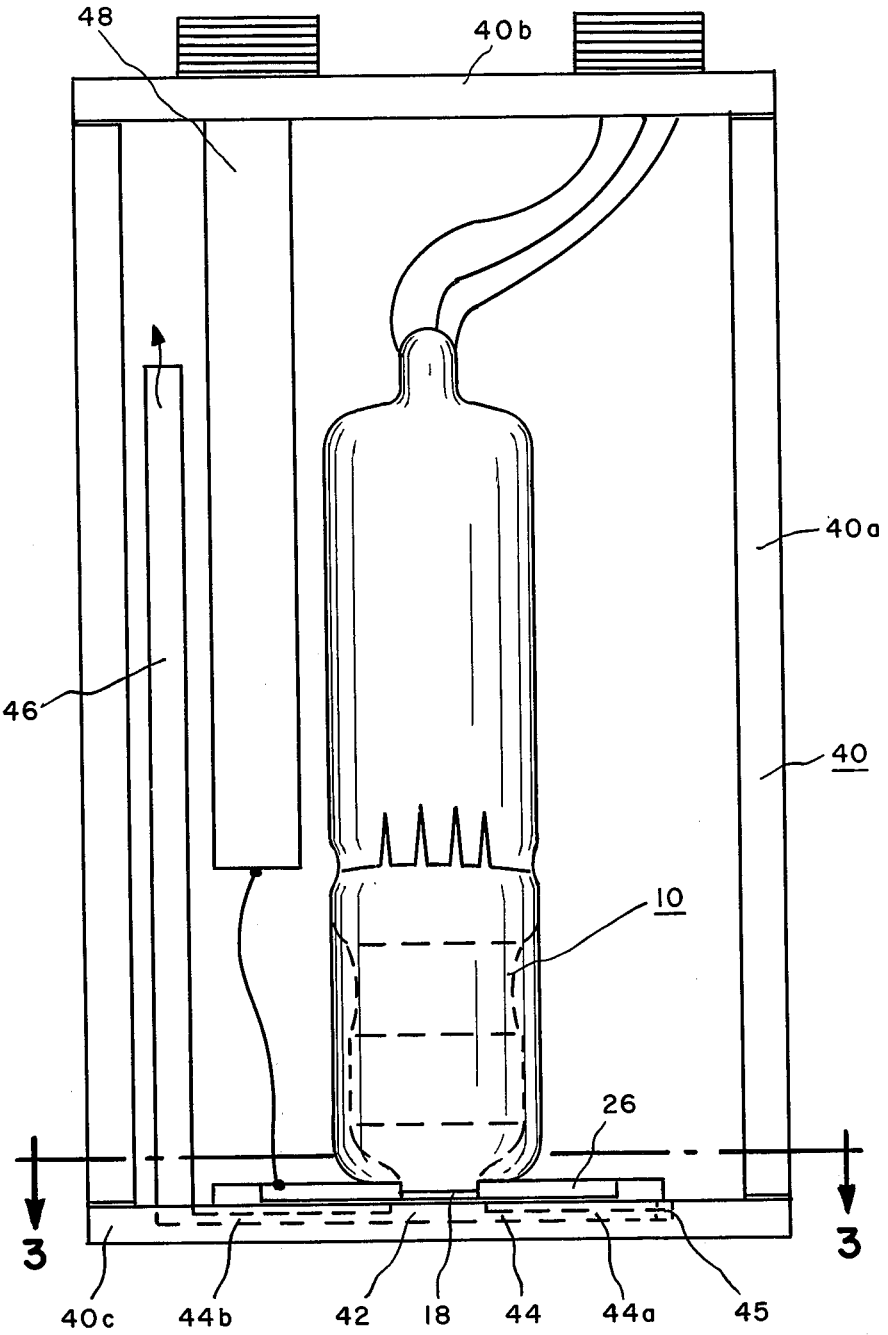
FIG. 2 is a sectional elevation view of the present invention according to a further embodiment.
Figure 3:
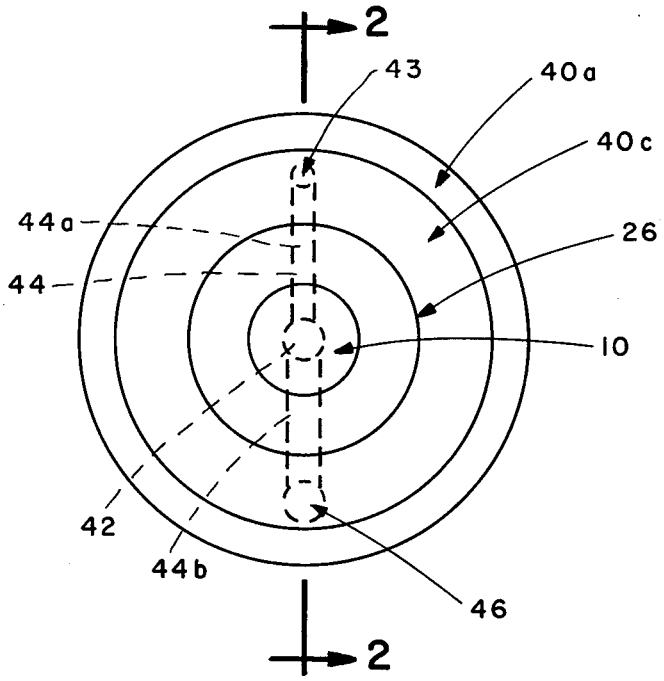
FIG. 3 is a sectional top view along axis 3—3 of the embodiment shown in FIG. 2.

According to another preferred embodiment (FIGS. 2 and 3), the invention comprises a transmission x-ray tube 10 (numerals common to FIGS. 1 and 2 depicting similar parts) that includes a mounting flange 26 and is located within a container member 40 that includes side, top, and bottom walls 40*a*, 40*b*, and 40*c*, respectively. The bottom wall 40*c*, at least, of the container member 40 (or at least the portion of the bottom wall 40*c*) is of x-ray transmissive material (e.g., a low density plastic material) and the window member 18 of the tube 10 is opposite it. The bottom wall 40*c* comprises a recess 42 at which the window member 18 is located, a channel 44 extending laterally from the recess, with a first part e.g., 44*a* of the channel forming the inlet and a second part 44*b* forming the outlet via which the heat transfer fluid can be transferred in heat transfer relationship with the window member 18. A second recess 43 connects the inlet with the interior of the container member 40 and a third recess 45 connects the outlet 44*b* with the interior of the container member 40.

The arrangement of the tube 10 as in FIG. 2 can further comprise a conduit 46 for carrying the heat transfer fluid away from the window member. There can also be present a high voltage connection 48 that can be connected to the window member 18 via the mounting member or flange 26, the recess 42 preferable being completely closed by the window 18 and possibly a part of the mounting member 26. The entire or part of the chamber interior is filled with oil or other suitable coolant fluid, with the fluid passing into the recess or opening 45, through the channel inlet part 44*a*, along the window member 18, out the channel outlet part 44*b*, and through the conduit 46, the fluid circulating in this manner via convection currents, and, thus, cooling the window member 18.

The x-ray target window, e.g., 18, can be of any vacuum-compatible high atomic number material, e.g., tungsten, gold, rhodium, silver, molybdenum, or platinum on, if desired, a substrate of beryllium or other suitable material that exhibits relatively high x-ray permeability.

Also, other materials usable for the transmission window, e.g., 28, are Plexiglas and Mylar, while either a liquid or a gas (e.g., sulfur hexafluoride, argon, Freon, or dry air) can be used as the coolant.

What is claimed is:

1. A transmission x-ray tube, comprising:

a. an envelope comprising a wall structure;

b. means for generating a charged particle beam;

c. x-ray permeable window means disposed at said wall structure;

d. means for directing said particle beam to said window means to produce x-rays;

e. structural means for providing a space at said window means, and comprising wall means and an x-ray permeable window element disposed opposite said window means;

f. means for transferring a heat transfer fluid through said space; and g. a flange structure for mounting said tube on an external support, said structural means and said flange structure comprising a unitary element.

2. A transmission x-ray tube as in claim 1, wherein said structural means is removably mounted on said envelope at said window means.

3. A transmission x-ray tube as in claim 1, wherein said window means is of a material selected from the group consisting essentially of beryllium and a plastic material.

4. A transmission x-ray tube as in claim 1, wherein said window means consists of a low atomic number material.

5. A transmission x-ray tube as in claim 1, wherein said window means consists of a low density plastic material.

6. A transmission x-ray tube as in claim 1, wherein said window means and said window element are proximately spaced to each other so as to achieve lamellar flow of said heat transfer fluid along said window means.

* * * * *